United States Patent [19]

Thaler et al.

[11] 4,220,838

[45] Sep. 2, 1980

[54] GAS-BLAST SWITCH

[75] Inventors: Richard Thaler, Unterentfelden; John Montigel, Aarau; Hans-Ulrich Meier; Moritz Jungo, both of Oberentfelden; Christian Tschannen, Unterentfelden; Tibor Morva, Oberentfelden, all of Switzerland

[73] Assignee: Sprecher & Shuh AG, Aargau, Switzerland

[21] Appl. No.: 964,081

[22] Filed: Nov. 27, 1978 (Under 37 CFR 1.47)

[30] Foreign Application Priority Data

Dec. 12, 1977 [CH] Switzerland ..... 15199/77

[51] Int. Cl.[2] ..... H01H 33/82

[52] U.S. Cl. ..... 200/148 A; 200/148 B; 200/148 F

[58] Field of Search ..... 200/144 R, 148 R, 148 A, 200/148 B, 148 C, 148 D, 148 E, 148 F, 148 G, 148 H, 148 J, 148 BV, 150 G

[56] References Cited

U.S. PATENT DOCUMENTS

| | | | |
|---|---|---|---|
| 3,924,088 | 12/1975 | Heutchi et al. | 200/150 G |
| 4,139,752 | 2/1979 | Itai et al. | 200/148 G |

*Primary Examiner*—J. V. Truhe
*Assistant Examiner*—Morris Ginsburg
*Attorney, Agent, or Firm*—Werner W. Kleeman

[57] ABSTRACT

A gas-blast switch having a hollow support insulator, and and at least one switching chamber housing supported thereon and within which there is arranged a set of fixed contacts, surrounded by a blast chamber, and a set of movable contacts. A blast nozzle coacts with the movable contacts and is connected with a pump device having a pump cylinder surrounding a pump chamber and movable with the movable contacts. The pump cylinder is displaceably arranged upon a stationary piston. A check valve opens towards the pump chamber. During the cut-on stroke pressurized gas is sucked by the valve into the pump chamber. The latter is connected by the check valve with a supply compartment communicating via inlets with the blast chamber and the internal space of the support insulator. A further valve is responsive to the pressure increase in the blast chamber, which valve, when responsive, interrupts the connection between the internal space of the support insulator and the inlets. The supply compartment is preferably formed by a cylindrical hollow body whose one end face serves as the pump piston, whereas at the end region of the outer surface of the hollow body furthest from such piston there are formed the through-passages or inlets as axially lengthwise extending slots. The valve may be a plate valve whose valve plate coacts with a valve seat affording access to the internal space of the support insulator and further, in its open position, subdivides the inlets into two sections, one opening into the supply compartment, the other by means of the valve seat into the internal space of the support insulator.

8 Claims, 1 Drawing Figure

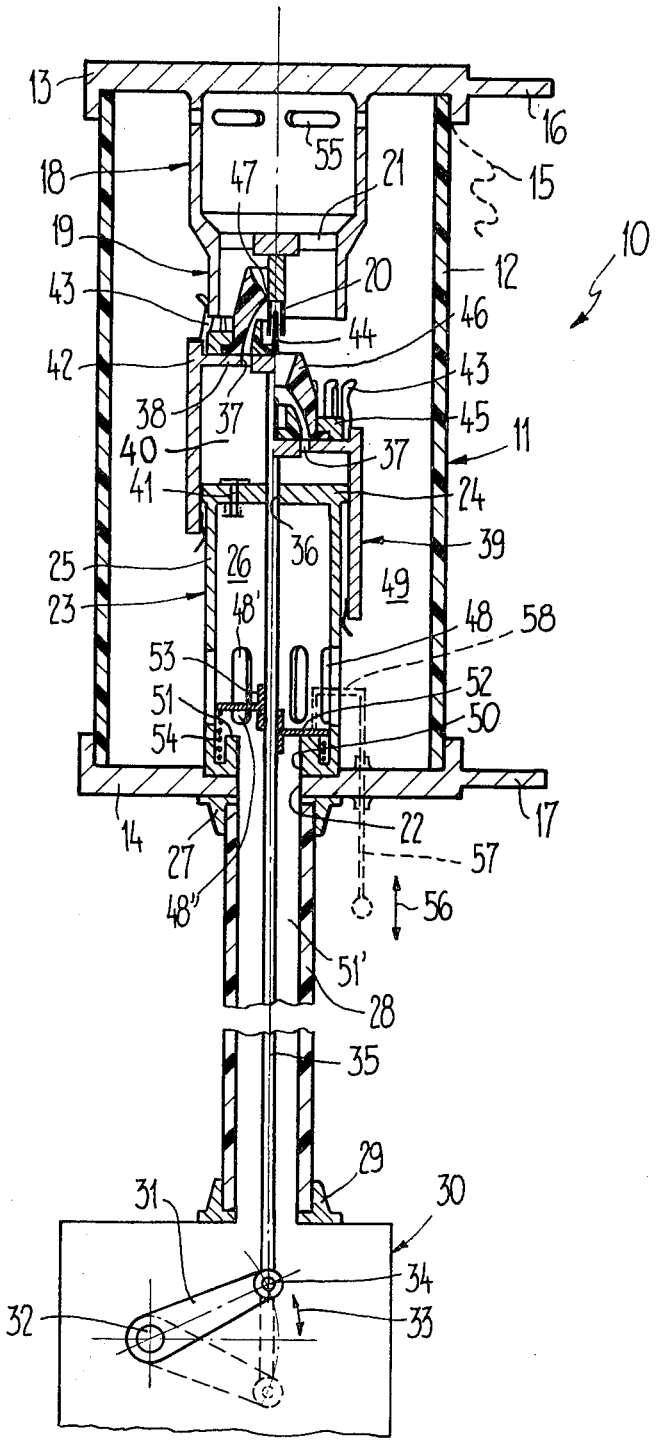
13
16
55
18
47
21
15
19
10
12
43
20
46
44
42
43
38
37
45
40
37
11
41
24
36
39
25
26
49
23
48'
48
58
53
52
51
50
54
14
22
17
27
57
48''
56
51'
28
35
29
31
30
34
32
33

GAS-BLAST SWITCH

BACKGROUND OF THE INVENTION

The present invention relates to a new and improved construction of a gas-blast switch.

The gas-blast switch of the invention is of the type comprising a hollow support insulator and at least one switching chamber housing supported thereon and having a hollow insulator in which there is arranged a set of fixed contacts, surrounded by a blast compartment or chamber, and a set of movable contacts. A blast nozzle is operatively associated with the set of movable contacts and is connected with a pump device. This pump device comprises a pump cylinder surrounding a pump chamber or compartment and movable along with the movable contacts. The pump cylinder, in turn, is mounted to be displaceable upon a stationary piston. A nonreturn or check valve is provided which merges with and opens in the direction of the pump chamber or compartment, pressurized gas being sucked-up into the pump chamber during the course of the cut-on or switching stroke.

Such switches are referred to as so-called "lifetank" switches, because the parts of the switch which are accessible from the outside are under voltage. The entire requirement of pressurized or extinguishing gas, for instance $SF_6$, is obtained from the contents of the switching chamber housing, the support insulator and, if desired, a drive housing merging with such support insulator. In contrast hereto, in the case of the so-called "deadtank" switches, i.e., switches encapsulated in a grounded metal container, the so-to-speak "gas container" from which there is drawn the extinguishing or quenching gas for blowing the arc, as a general rule is larger by that volume which remains free between the parts of the switch and the metal container.

The switches of the initially mentioned type, thus, in comparison to the so-called "deadtank" switches, contain an appreciably smaller quantity of extinguishing or quenching gas. Therefore, attempts have been made with such switches to avoid, to the extent possible, gas chambers or spaces which are separated from one another and normally, that is to say, in the cut-on or cut-off position, to favor a certain gas circulation. This is particularly so in the case of switches which are erected in the open, wherein heating of the extinguishing gas is needed in the presence of low ambient temperatures, in order to prevent condensation of the extinguishing or quenching gas.

The blowing of the arc during the course of the cut-off stroke causes in the blast chamber or compartment—in other words in a spatially limited region—an appreciable pressure and temperature increase. While the pressure increase tends to propagate to all parts of the switch practically without any delay, the temperature increase initially is limited to the region of the blast chamber and a compensation of the temperature by the gas at the more remote locations, such as for instance at the drive housing, only occurs gradually. If there is considered that the quantity of gas in the switch is constant, it will be apparent that at that location where there prevail increased gas pressure and also an appreciable temperature increase governed by the arc, there is present lower gas density, than at that location where initially there has been brought about the pressure increase, and possibly a low temperature increase due to the compression.

Now if, as is the rule with a heretofore known switch of the previously mentioned type, for instance as taught in French Pat. No. 2,291,601 or Swiss Pat. No. 582,420, following a cut-off or switch-off operation, caused by a short-circuit condition, there is again automatically triggered a cut-on switching operation after several tenths of a second, then in the pump chamber or compartment gas will be sucked-up from that region where the density of the gas has decreased owing to the previously mentioned cut-off operation. Now if following the automatic cut-on or switching-in operation the short-circuit has not been eliminated and there directly follows a second cut-off operation, approximately 0.3 seconds after the first cut-off or switching-off operation, then there is only available in the pump chamber gas having a low density for blowing the arc which has formed during the course of this cut-off operation. Gas of lower density however means lower dielectric strength and reduced cut-off efficiency.

Thus, with a "lifetank" switch of the previously mentioned type there must be reckoned with a quite appreciable reduction of the cut-off efficiency when there are undertaken brief successive cut-off or switching-off operations.

SUMMARY OF THE INVENTION

Hence, it is a primary object of the present invention to provide a new and improved construction of a switch of the previously mentioned type which extensively avoids the above-discussed drawbacks and limitations.

Now this object and others which will become more readily apparent as the description proceeds, can be attained with a switch of the previously mentioned type, according to the teachings of the invention, in that the pump chamber is connected by means of the check or nonreturn valve with a supply chamber or compartment communicating by means of inlets with the blast chamber and the inner space or chamber of the support insulator. Further, there is provided a valve responsive to pressure increases in the blast chamber, in order that when this valve responds, there is suppressed the connection between the inner space of the support insulator and the inlets.

With the proposed switch, owing to the suppression of the connection to the internal chamber of the support insulator, the pressure surge which has formed in the blast chamber during the switching-off operation only, as intended, acts upon the still cold gas quantity present in the supply compartment. Hence, this gas quantity is compressed and with a directly following cut-on stroke is sucked in this condition into the pump chamber, so that there is available for the blowing of the arc, during a directly following switching-off operation, gas whose properties as concerns its extinguishing capability, are at least comparable to that of the gas which was used for blowing the first arc.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE, without being to scale, shows in schematic longitudinal sectional view a gas-blast switch according to the invention, the left-hand portion of which is shown in its cut-on or switching-in position, and the right-hand portion is shown during the course of the cut-off or switching-off stroke.

DETAILED DESCRIPTION OF THE PREFERRED EMBODIMENTS

Describing now the drawing, the illustrated exemplary embodiment of gas-blast switch 10 will be seen to comprise a switching chamber or switching compartment housing 11. This switching compartment housing 11 is constituted by a substantially tubular-shaped insulating body or body member 12. Both opposed ends of the insulating body 12 are sealingly closed by conductive closure flanges 13 and 14 or equivalent structure. The insulating body 12, as indicated by broken lines 15, also can be formed by a porcelain insulator.

The electrical connections or terminals 16 and 17 of the switch 10 are connected with the closure flanges 13 and 14, as has only been schematically indicated. Connected with the closure flange 13 is a fixed contact body 18 which protrudes into the interior or internal compartment of the housing 11. This fixed contact body 18, in turn, comprises a contact tube 19 serving as a power contact and a contact bushing or sleeve 20 serving as a burn-off contact and arranged coaxially within the contact tube 19. The contact bushing 20 is attached by means of spoke-like struts 21 at the inside or inner wall of the contact tube 19.

Attached to the closure flange 14, which is centrally provided with a throughpass opening or throughpassage 22, is a substantially cylindrical hollow body 23 formed of electrically conductive material. The end of the hollow body 23 which is remote from the flange 14 is sealed by an end wall structured as a piston 24. This piston 24 and the jacket or outer surface 25 of the hollow body 23 therefore enclose a supply compartment or chamber 26, the function of which will be described in greater detail hereinafter.

Sealingly connected with the outside of the flange 14, by means of a connection collar or sleeve 27, is an electrically insulating support tube or pipe 28 which is in alignment with the throughpass opening 22. The lower end of the support tube 28 is sealingly connected by means of a connection collar or sleeve 29 at a merely schematically indicated drive housing 30. Within the drive housing 30 there is arranged, for instance, a drive crank 31 which can be rocked in the direction of the double-headed arrow 33 about its shaft 32 by any suitable and therefore not further shown drive means. In the drawing the crank 31 is shown in the position, represented by full lines, corresponding to the cut-on or switching-on position, and by means of the broken or phantom lines has been shown in the position corresponding to the cut-off or switching-off position. At the free end of the crank 31 there is articulated at location 34 a thrust and traction rod 35 formed of insulating material. This thrust and traction rod 35 extends coaxially through the support tube 28, the opening 22, through the hollow body 23 which is open (opening 50) at the opening 22 and through a bore 36 provided in the piston 24. At the upper end of the rod 35 there is attached the base or floor 38 of a pump cylinder 39. This pump cylinder floor 38 is provided with the throughpassages or passageways 37. The inner space of the pump cylinder 39 between the piston 24 and the cylinder floor 38 thus constitutes a pump chamber or compartment 40. This pump chamber 40 is only connected with the supply compartment or chamber 26 by means of a nonreturn or suction valve 41 which opens towards the pump chamber 40 and is arranged in the piston 24.

At the outer shell or jacket 42 of the pump cylinder 39, and which jacket protrudes past the cylinder floor or base 38, there is attached a rim of resilient contact fingers 43, which, for the left-hand illustrated cut-on position of the gas-blast switch, bear at the outside of the contact tube 19. Further, there is secured at the floor 38, at the central region of the side confronting the piston 24, a contact pin 44 serving as a burn-off contact and which engages into the bushing 20 in the cut-on position of the gas-blast switch. The passageways 37 in the floor or base 38 open into a blast nozzle 46 formed of insulating material and which is secured by means of an attachment ring 45 at the outside of the floor or base 38. The narrowest location or throat 47 of the blast nozzle 46, at the left-hand illustrated cut-on position, so-to-speak sealingly encloses the outer side of the bushing 20.

At the end region of the hollow body 23 which is remote from the piston 24 there are provided at its outer surface or jacket 25 substantially slot-shaped inlets 48 which extend in axial direction. By means of the slot-shaped inlets or openings 48 the supply compartment 26 normally flow communicates both with a blast chamber or compartment 49 in the switching compartment housing 11 as well as also, by means of the lower opening 50 of the hollow body 23, with the internal space or chamber 51' of the support tube 28.

The edge of the opening 50, confronting the supply compartment 26, is formed as a valve seat 51 with which there is operatively associated as a closure element a substantially ring-shaped or annular valve plate 52. This valve plate 52 is displaceably and sealingly guided along the rod 35 by means of a hub portion 53 and furthermore is exposed to the action of a spring 54 which strives to retain the valve plate 52 in a position raised from the valve seat 51. In this position, as shown at the left-hand side of the drawing, the valve plate 52 divides the inlets 48 into two sections, namely: a larger section or portion 48' which flow communicates the supply compartment or chamber 26 with the blast chamber or compartment 49 and a smaller section or portion 48'' which establishes the flow communication between the internal chamber 51' and the blast chamber or compartment 49.

Now if there is accomplished a cut-off or switching-off operation, then by means of the crank 31 and via the rod 35 the pump cylinder 39 together with the thereat attached contact fingers 43 and the contact pin 44 are drawn downwardly. Consequently, initially the contact fingers 43 come out of engagement with the contact tube 19. The gas in the pump chamber 40 experiences a pre-compression, since the blast nozzle 46 still is closed by the bushing part 20. As soon as the contact pin 44 leaves the bore in the bushing part 20 there is ignited an arc which is blown by the extinguishing or quenching gas flowing out under pressure from the pump chamber 40 through the now free blast nozzle 46. This gas is forcefully heated and thus experiences a pressure increase. It expands past the struts 21 in the interior of the contact body 18 and from that location flows via the slots 55 provided therein into the blast chamber 49. The pressure surge which is formed in such blast chamber or compartment 49 propagates through the inlets 48 and the valve plate 52 is pressed against the action of the spring 54 onto the valve seat 51 because the throughflow cross-section of the portion or section 48' is larger than that of the portion or section 48''. Consequently, there is also suppressed, as shown at the righthand side of the drawing, the connection to the internal space or chamber 51' of the support tube 28 and the pressure surge acts completely upon the gas located in the supply compartment 26. Yet, the heating of the gas, brought about by the arc, as already mentioned, lags in time behind the compression mode. Consequently, the average density of the gas in the supply compartment 26 temporarily increases and, in any case, for such length of time until there is again accomplished automatically a switching-in or cut-on operation. During this renewed switching-in operation the more dense gas flows into the pump chamber 40 where there then is available gas which is faultless as to its extinguishing characteristics for any further directly following switching-off operation.

The advantageous effects of the supply compartment 26 are particularly then discernible if its volume is greater, preferably 1.1 to 1.8 times greater, than the volume of the pump chamber 40 in its switching-in position.

With the illustrated switch 10 the valve formed by the valve seat 51 and the valve plate 52 additionally can assume a further function. In particular, such valve 51, 52 serves to completely seal from the outside the switching compartment housing 11, something of significance during the assembly and disassembly work. As indicated with the phantom lines there can be provided an actuation rod 57 which is movable in the direction of the double-headed arrow 56 between two end or terminal positions back and forth and can be arrested in such terminal position. This actuation rod 57 is sealingly guided through the closure flange 14. At its upper end such rod 57 is provided with a hook 58 or equivalent structure, which, starting from the blast chamber 49, extends through one of the inlets 48 into the supply compartment 26 and with its free end is located opposite the side of the valve plate 52 confronting the supply compartment 26. If the rod 57 is downwardly drawn, then the valve plate 52 is drawn downwardly into its closed position, even if there is not present any excess pressure in the blast chamber or compartment 49. Consequently, the switching compartment housing 11 is sealed and, for instance, can be dismantled from the support tube 28 without extinguishing or quenching gas escaping out of the switching compartment housing 11, or conversely, without air, moisture or dust entering into the switching compartment housing 11. On the other hand, if the rod 57 is upwardly displaced, then there is freed the valve plate 52, so that it can assume the function described heretofore.

While there are shown and described present preferred embodiments of the invention, it is to be distinctly understood that the invention is not limited thereto, but may be otherwise variously embodied and practiced within the scope of the following claims. Accordingly,

What we claim is:

1. A gas-blast switch comprising:

a hollow support insulator having an internal space;

at least one switching compartment housing having a hollow insulator and supported on said support insulator;

said switching compartment housing containing a blast chamber;

a set of fixed contacts arranged in said switching compartment housing;

a set of movable contacts arranged in said switching compartment housing;

said sets of fixed and movable contacts being surrounded by said blast chamber;

a blast nozzle for extinguishing gas operatively associated with said set of movable contacts;

a pump device with which there is operatively connected said blast nozzle;

said pump device comprising a pump cylinder surrounding a pump chamber and movable in conjunction with the movable contacts;

said pump device further including a stationary pump piston;

said pump cylinder being displaceably mounted upon said stationary pump piston;

a nonreturn valve cooperating with the pump chamber and opening into said pump chamber;

pressurized extinguishing gas being sucked-up into the pump chamber by means of the nonreturn valve during the course of a switching-in stroke of the gas-blast switch;

a supply compartment;

said pump chamber being connected by means of said nonreturn valve with said supply compartment;

inlet means for flow communicating said supply compartment with said blast chamber and the internal space of said support insulator;

valve means responsive to the pressure increase of the extinguishing gas in the blast chamber;

said valve means, upon response thereof, interrupting the flow communication between the internal space of the support insulator and the inlet means.

2. The gas-blast switch as defined in claim 1, wherein:

said supply compartment is formed in a hollow body having an end face serving as said pump piston.

3. The gas-blast switch as defined in claim 2, wherein:

said hollow body possesses a substantially cylindrical construction and has an end remote from said pump piston;

said valve means including a valve seat formed in said end of said hollow body;

said valve seat having an opening leading into the internal space of said support insulator;

said valve means further including a valve plate resiliently held in an open position, serving as a closure element, and cooperating with said valve seat to free said opening into the internal space of said support insulator.

4. The gas-blast switch as defined in claim 3, wherein:

said valve plate has an outer diameter essentially corresponding to the inner diameter of the hollow body.

5. The gas-blast switch as defined in claim 4, wherein:

said inlet means comprise slots extending in axial direction and formed at the outer surface of the hollow body at the end region thereof remote from said pump piston;

said slots being divided by the valve plate in the open position thereof into two sections having dissimilar flow cross-sections; and the sections of said slots having the larger flow cross-section constituting flow connection means between the supply compartment and the blast chamber.

6. The gas-blast switch as defined in claim 1, wherein:

the volume of the supply compartment is larger than the volume of the pump chamber in the switching-in position of the gas-blast switch.

7. The gas-blast switch as defined in claim 6, wherein:

the volume of the supply compartment amounts to approximately 1.1 to 1.8 times the volume of the pump chamber in the switching-in position.

8. The gas-blast switch as defined in claim 1, further including:

externally actuatable means in order to interrupt, by means of said valve means, the connection between the internal space of the support insulator and the inlet means.

* * * * *